US008991651B2

(12) United States Patent
Yeh

(10) Patent No.: US 8,991,651 B2
(45) Date of Patent: Mar. 31, 2015

(54) RECONFIGURABLE APPLICATOR SYSTEM HAVING COMBINATION TRIGGER ACTUATION

(71) Applicant: Patent & Investment LLC, Jessup, MD (US)

(72) Inventor: Stanley Yeh, Taichung (TW)

(73) Assignee: Patent & Investment LLC, Jessup, MD (US)

( * ) Notice: Subject to any disclaimer, the term of this patent is extended or adjusted under 35 U.S.C. 154(b) by 0 days.

(21) Appl. No.: 13/748,098

(22) Filed: Jan. 23, 2013

(65) Prior Publication Data

US 2013/0186912 A1 Jul. 25, 2013

Related U.S. Application Data

(60) Provisional application No. 61/589,489, filed on Jan. 23, 2012.

(51) Int. Cl.

| | |
|---|---|
| ***B67D 7/70*** | (2010.01) |
| ***B65D 83/00*** | (2006.01) |
| ***B05C 17/005*** | (2006.01) |
| ***B05C 17/015*** | (2006.01) |

(52) U.S. Cl.

CPC ..... *B65D 83/0005* (2013.01); *B05C 17/00553* (2013.01); *B05C 17/015* (2013.01)

USPC ..... 222/137; 222/469; 222/473; 222/326; 222/386.5; 222/391; 222/399; 222/325

(58) Field of Classification Search

CPC .. B65D 83/0005; B65D 81/325; B65D 88/54; B05C 17/00573; B05C 17/015; B05C 17/00553; G01F 11/022

USPC ..... 222/389, 391, 386.5, 137, 326, 324, 222/469, 4, 472, 473, 334, 333, 323, 262, 222/263, 261, 258, 145.5, 145.6, 142.3, 222/399, 325; 81/177.1, 177.7, 489, 491; 239/526, 527; 173/170, 217, 166, 171

See application file for complete search history.

(56) References Cited

U.S. PATENT DOCUMENTS

| | | | | |
|---|---|---|---|---|
| 5,046,642 | A * | 9/1991 | Cathcart et al. | 222/153.09 |
| 5,224,629 | A * | 7/1993 | Hsich | 222/137 |
| 5,246,144 | A * | 9/1993 | Cathcart et al. | 222/153.13 |
| 6,286,718 | B1 * | 9/2001 | Durrant | 222/80 |
| 6,290,101 | B1 * | 9/2001 | Chang | 222/137 |
| 7,905,375 | B2 * | 3/2011 | Schneider et al. | 222/389 |
| 8,616,415 | B2 * | 12/2013 | Brummitt | 222/389 |
| 2011/0056996 | A1 * | 3/2011 | Schneider et al. | 222/333 |

* cited by examiner

*Primary Examiner* — Frederick C Nicolas
*Assistant Examiner* — Bob Zadeh
(74) *Attorney, Agent, or Firm* — Rosenberg, Klein & Lee

(57) ABSTRACT

A reconfigurable applicator system for extrusive dispensing of a work material is provided. The system includes a body portion having an actuator coupled thereto. A frame portion coupled to the body portion defines a support structure for at least one cartridge unit containing the work material. A combination trigger handle portion is coupled to the body portion to be adjustable between angularly displaced first and second grip positions relative to the frame portion. The combination trigger handle portion includes at least first and second selectable triggers coupled to the actuator, which responds to each of the first and second triggers to actuate extrusive dispensing of the work material from the cartridge unit. The combination trigger handle portion in the first and second grip positions alternatively configures the system between overhand and underhand configurations.

20 Claims, 14 Drawing Sheets

RECONFIGURABLE APPLICATOR SYSTEM HAVING COMBINATION TRIGGER ACTUATION

RELATED APPLICATION DATA

This application is based on Provisional Patent Application No. 61/589,489, filed 23 Jan. 2012.

BACKGROUND OF THE INVENTION

The present invention is directed to a system for dispensing and applying a work material to various work areas. More specifically, the present invention is directed to an applicator system which may be easily and conveniently reconfigured in the field to be ergonomically adapted for various application conditions. The reconfigurable applicator system thus relieves the physical strain otherwise incurred by an operator over prolonged periods of operation.

Various dispensing devices for sealant, adhesive, epoxy, caulk, and other such pasty materials are known in the art. They include gun-type devices with pneumatic measures for driving the flow of the given material(s) from containers or cartridges for application on a particular work surface or area. In heavy duty applications, or where multiple cartridges are used for combined dispensing of complementary materials, the dispensing device may be quite substantial in bulk and mass.

Particularly over prolonged periods of use, this requires considerable physical exertion of the user. The bulk and mass of the device and its material payload alone would invariably wear on the user's stamina. Add to this the strain of awkwardly contorting the body to reach both raised and low-lying work areas with the same device, and the task of applying the material(s) often becomes quite formidable. Lower back and leg strain, and the dangerous risk of losing one's balance at a hazardous work site are all too often the result. The task is only made more difficult by the user's need to constantly hold the material cartridge(s) in place within the device when it is reoriented and manipulated, for instance, to reach low-lying areas.

Known applicator devices may simply be flipped or otherwise re-oriented for use in different situations. This cannot be done without considerable added effort on the user's part to secure the material cartridge(s) so that proper dispensing and application operation is preserved in the device. Other applicator devices are known which may be taken apart and reassembled to suit different application tasks. Even if the disruption in work flow this requires could be afforded, the user is typically not equipped with sufficient tools (or know how) to break down the applicator, rearrange or replace disassembled parts, then put back together with reasonable efficiency or accuracy. Nor would the work area—such as on precarious locations of partially built structures or in other debris-strewn, high active areas of construction sites—normally provide an environment conducive to intricate operations like that.

There is, therefore, a need for an applicator device that may be easily and conveniently adapted for convenient, ergonomically suited use in various situations. There is a need for such applicator device which may be adaptively operated by users to just as comfortably apply a given material to higher application areas situated generally above their waist level, as to lower areas situated below waist level. There is a need for an applicator device which may be so adaptively operated without having to carry out extensive disassembly and reassembly procedures in the field.

SUMMARY OF THE INVENTION

It is an object of the present invention to provide an applicator system which may be easily and conveniently adapted for convenient, ergonomically suited use in various situations.

It is another object of the present invention to provide an applicator system which may be adaptively operated without requiring extensive disassembly and reassembly procedures in the field.

These and other objects are attained by a reconfigurable applicator system formed in accordance with the present invention for extrusive dispensing of a work material comprising a body portion having an actuator coupled thereto. A frame portion coupled to the body portion defines a support structure for at least one cartridge unit containing the work material. A combination trigger handle portion is coupled to the body portion to be adjustable between angularly displaced first and second grip positions relative to the frame portion. The combination trigger handle portion includes at least first and second selectable triggers coupled to the actuator, which responds to each of the first and second triggers to actuate extrusive dispensing of the work material from the cartridge unit. The combination trigger handle portion in the first and second grip positions alternatively configures the system between overhand and underhand configurations.

An ergonomically reconfigurable applicator system formed in accordance with certain embodiments of the present invention for extrusive dispensing of a work material comprises a body portion having an actuator coupled thereto. A frame portion is coupled to the body portion, which frame portion defines a support structure for at least one cartridge unit containing the work material. The frame portion includes a stabilization member coupled to the support structure for releasably securing a proximal end of the cartridge unit therein, and a stopping member retractably coupled to the support structure for releasably capturing a distal end of the cartridge unit therein. A combination trigger handle portion is coupled to the body portion to be angularly displaceable between at least first and second grip positions relative to the frame portion. The combination trigger handle portion includes at least first and second selectable triggers coupled to the actuator, with the actuator responding to each of the first and second triggers to actuate extrusive dispensing of the work material from the cartridge unit. The combination trigger handle portion in the first and second grip positions alternatively configures the system between overhand and underhand configurations, with the frame portion maintaining uninterrupted retention of the cartridge unit within the support structure when the system configured in one of the overhand and underhand configurations is alternatively operated in a complementary orientation corresponding to the other of the overhand and underhand configurations.

An ergonomically reconfigurable applicator system is formed in accordance with certain embodiments of the present invention for pneumatically powered extrusive dispensing of a work material, and comprises a frame portion defining a cartridge bay structure for at least one cartridge unit containing the work material. The frame portion includes a stabilization member coupled to the cartridge bay structure for releasably securing a proximal end of the cartridge unit therein, and a stopping member retractably coupled to the cartridge bay structure for releasably capturing a distal end of the cartridge unit therein. A body portion coupled to the frame portion includes a cylinder for driving a piston unit in pneumatically powered manner to extend reversibly therefrom into the frame portion and actuate extrusive dispensing of the work material from the cartridge unit. A combination trigger handle portion is adjustably coupled to the body portion for slidable angular displacement thereabout between a pistol grip and suitcase grip positions. The combination trigger handle portion includes at least first and second grip members transversely oriented one relative to the other, and at least first and second selectable triggers coupled respectively to the first and second grip members to selectively open and close respective first and second pneumatic paths for directing a pneumatic flow from a source to said cylinder therethrough. The combination trigger handle portion in the pistol and suitcase grip positions alternatively configures the system between overhand and underhand configurations with respect to the cartridge bay structure in an upright orientation. The frame portion maintains uninterrupted retention of the cartridge unit within the cartridge bay structure when the system configured in one of the overhand and underhand configurations is alternatively operated with the cartridge bay structure in a inverted orientation consistent with the other of the overhand and underhand configurations.

DETAILED DESCRIPTION OF THE PREFERRED EMBODIMENTS

Figure 1A:
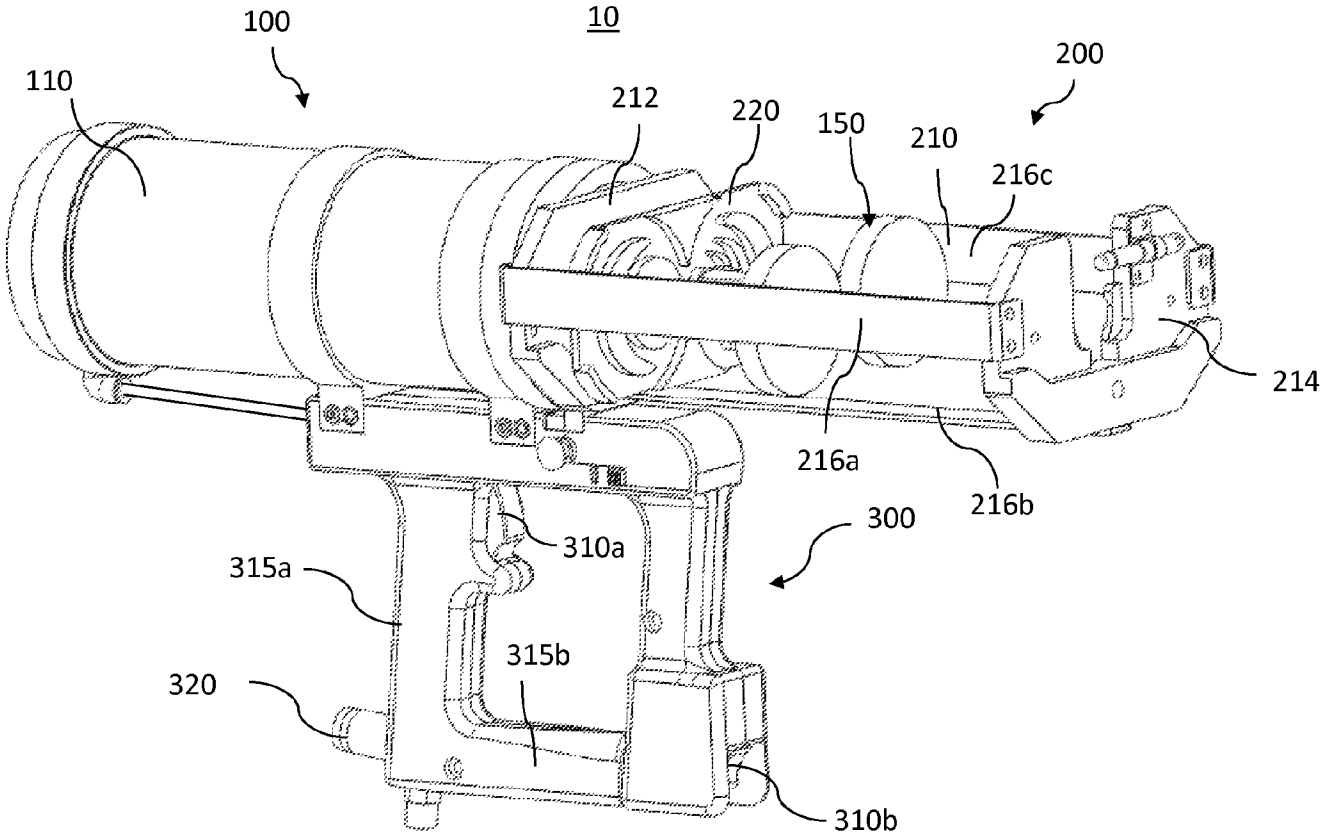
FIG. 1A is a side perspective view of a system formed in accordance with one exemplary embodiment of the present invention, set to a first operational configuration and shown in an upright orientation for that operational configuration.
Figure 1B:
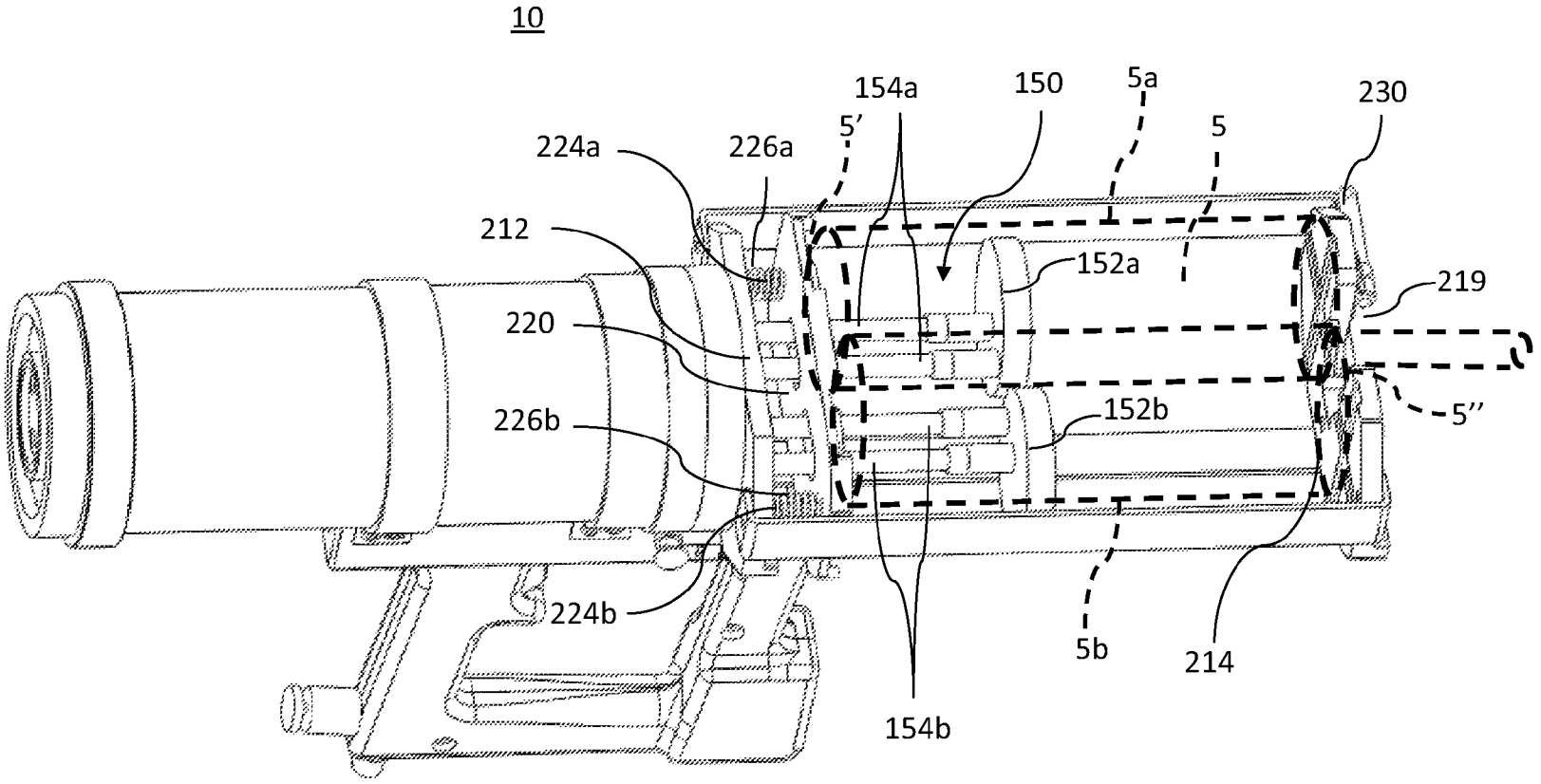
FIG. 1B is a top perspective view of the system embodiment of FIG. 1A, set to the first operational configuration and shown in an upright orientation.

Referring now to FIGS. 1A-1B there is illustratively shown a reconfigurable applicator system 10 formed in accordance with one exemplary embodiment of the present invention. Briefly, the reconfigurable applicator system 10 permits simple and convenient adaptation by the user as needed for ergonomically suited use in various situations. The reconfigurable applicator system may be adaptively operated by users in an overhand configuration with its trigger and handle in a pistol grip position to comfortably apply the given material to higher application areas situated generally above their waist level. Alternatively, the system may be reconfigured to be adaptively operated in an underhand configuration with its trigger and handle in a suitcase grip position to just as comfortably apply the given material to lower areas situated below waist level, without having to assume a contorted crouching or other such awkward position. Where necessary, the system may be adaptively set to different or additional configurations with the trigger and handle accordingly adjusted in angular position. The system may be adaptively reconfigured quite simply and conveniently in this manner, without the need for extensive disassembly and reassembly procedures in the field.

The system 10 is actuable by a user to extrusively dispense a work material onto the given work area. Depending on the intended application, the system may be manually powered by user manipulation of one or more triggers. Alternatively, the system may be power assisted (either partially or fully), where user activation of a trigger actuates a power-assisted, automatic drive of the dispensing process. The power assist may be of pneumatic, hydraulic, electro-mechanical, electromagnetic, or any other type suitable for the intended application. In the exemplary embodiment shown, the system 10 is pneumatically powered, preferably though not necessarily, by interconnection to an external source of pneumatic pressure.

Figure 1C:
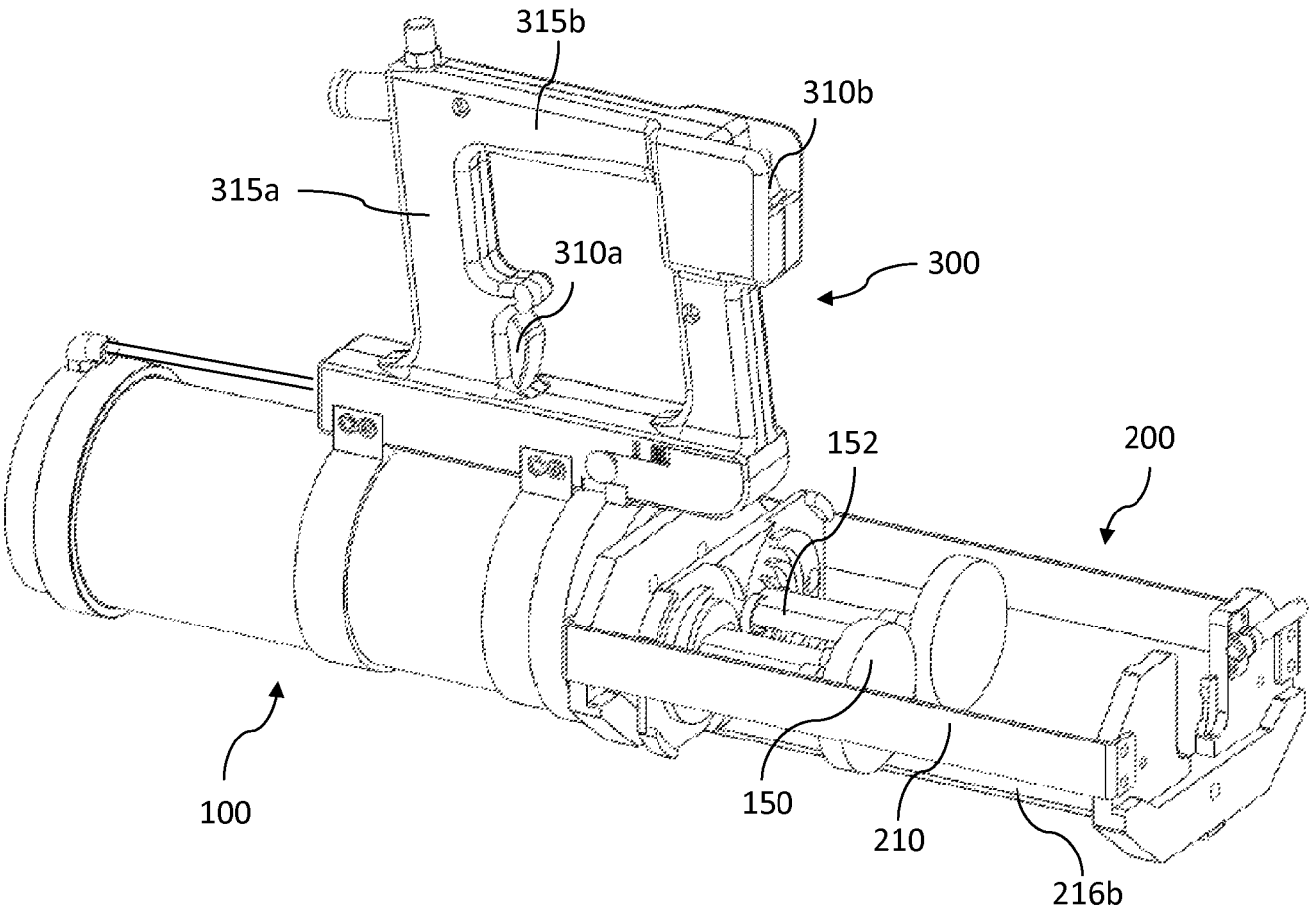
FIG. 1C is a flipped side perspective view of the system embodiment of FIG. 1A, set in a second operational configuration and shown in an upright orientation for that operational configuration.

As shown, the system 10 generally includes a body portion 100 having an actuator 150 coupled thereto. The system 10 further includes a frame portion 200 coupled to the body portion 100 which defines a support structure 210 for receiving at least one cartridge unit 5 (FIG. 1B) containing the work material. A combination trigger handle portion 300 is coupled to the body portion 100 to be adjustable between angularly displaced first and second grip positions relative to the frame portion 200, as illustrated in FIGS. 1A and 1C. The combination trigger handle portion 300 includes at least first and second selectable triggers 310*a*, 310*b* operably coupled to the actuator 150, which responds to each of the first and second triggers 310*a*, 310*b* to actuate extrusive dispensing of the work material from the cartridge unit 5. The combination trigger handle portion 300 in the first and second grip positions alternatively configures the system 10 between overhand (FIG. 1A) and underhand (FIG. 1C) configurations.

In the exemplary embodiment shown, the body portion 100 includes a pneumatic cylinder 110 which stores pressurized air (or other suitable gas) and applies the same to pneumatically drive piston portions of the actuator 150 to extend or retract accordingly, in response to actuation of either the first or second trigger 310,*a*, 310*b*. The combination trigger handle portion 300 is adjustably coupled to the cylinder 110 for slidable angular displacement thereabout between the pistol grip and suitcase grip positions. Such combination trigger handle portion 300 preferably includes at least first and second grip members 315*a*, 315*b* which are transversely oriented one relative to the other. The first and second selectable triggers 310,*a*, 310*b* are respectively coupled to the first and second grip members 315*a*, 315*b*, such that a user may actuate either trigger to selectively open and close one of two pneumatic paths for directing a pneumatic flow from a source coupling 320 to the cylinder 110 therethrough. In the embodiment shown, the first trigger and grip member 310*a*, 315*a* form a pistol trigger and grip, while the second trigger and grip member 310*b*, 315*b* form a suitcase trigger and grip.

Such features as the number of trigger and grip handle member combinations, their arrangement, and the overall shape or profile of the trigger handle portion may be varied to suit the particular requirements of the intended application. For example, while two sets of trigger-handle member combinations are shown in the illustrated embodiment arranged along two sides of a structure defining a generally rectangular loop, alternate embodiments need not be limited to such features. Different numbers of trigger-handle member combinations may be employed, and they may be arranged to define various other structural profiles for the portion 300, so long as the ease of reconfiguration between alternative trigger/grip settings realized in accordance with the present invention is preserved.

The frame portion 200 in the disclosed embodiment preferably defines an open cage type support structure which forms an easily accessible cartridge bay. The cartridge bay may be formed with any suitable structural configuration, but such open cage type configuration typically provides optimal combinations of strength, rigidity, weight, simplicity, and cost. In the disclosed embodiment, the cartridge bay is preferably configured to accommodate a multi-component cartridge unit 5 having multiple cartridge tube sections 5*a*, 5*b* that terminate at separate proximal ends 5' but merge together at a joint distal end 5". Such multi-component cartridge units are used, for instance, to concurrently dispense a mixture of various compositions for sealant, adhesive, epoxy, caulk, and/or other such pasty materials known in the art.

The support structure is typically formed to be open at the top, unobstructed by any support members extending thereacross, to minimize weight while preserving free open access for insert and removal of the cartridge unit therein. The support structure in the disclosed embodiment includes, for example, formed with proximal and distal end plates 212, 214 between which side and bottom support members 216*a*, 216*b*, 216*c* longitudinally extend to define a cradle-like cartridge bay. The support structure is thereby formed with an upright orientation established by this open top cartridge bay.

The frame portion 200 includes a stabilization member 220 coupled to the support structure 210 for releasably securing a proximal end of the cartridge unit 5 therein. The frame portion 200 further includes a stopping member 230 retractably coupled to the support structure 210 for releasably capturing a distal end of the cartridge unit 5 therein. The stabilization and stopping members 220, 230 respectively engage the distal and proximal ends (or aft and forward regions) of the cartridge unit 5 to cooperatively capture that cartridge unit 5 within the cartridge bay, even when the support structure 210 is inverted such that the open top of the cartridge bay faces downward.

This may occur, for example, where the system 10 is set in its overhand configuration (where the combination trigger handle portion 300 is at its pistol grip position with respect to an upright cartridge bay), yet is temporarily flipped over and operated using the suitcase grip member and trigger 315*b*, 310*b*. Conversely, the system 10 may be set in its underhand configuration (where the combination trigger handle portion 300 is at its suitcase grip position with respect to an upright cartridge bay), but is temporarily inverted and operated by a user via the pistol grip member and trigger 315*a*, 310*a* without reconfiguration. Even so, the frame portion 200, with cooperative effect of the stabilization and stopping members 220, 230, is able to maintain uninterrupted retention of the cartridge unit 5 within the cartridge bay.

In the embodiment shown, multiple cartridge sections respectively containing multiple material components are employed in tandem. The cylindrical tubes which make up the cartridge sections are provided much like multiple tubes of caulk, which are positioned with their respective dispensing tips converging to a central point. Their respective materials, say components A and B, get mixed as they are dispensed into a static mixer, so that by the time they leave the mixer, the mixture ratio is precisely what it should be because the A component side contributes one part of the desired composition while and the B component side concurrently contributes the other. Once those components interact, there is a certain time before the resulting mixture cures.

The multiple drive pistons 154*a*, 154*b* for driving the component material to dispense from the two cartridge sections are preferably actuated together. In the embodiment shown, four pistons 154*a*, 154*b* are employed to ensure suitable stability in driving the component materials out of their cartridge sections. This may be varied depending on the size of the system's pneumatic application structure. The multiple pistons ensure a sufficient distribution of driving force upon the movable disc-like panels of the cartridge section which are driven to squeeze out their materials.

The pistons 154*a*, 154*b* may be operably linked to the actuating trigger mechanism via any suitable transmission/coupling linkage known in the art to effect each piston's displacement responsive to trigger activation. For example, mechanical, electromechanical, pneumatic, hydraulic, electromagnetic, or other such transmission/coupling linkage types known in the art may be employed to suit the particular requirements of the intended application. The linkage mechanism may provide power assist as in the pneumatically powered example disclosed, or may in alternate embodiments simply convey the requisite force responsive to trigger actuation without power assist.

When system 10 is operated in this manner to apply the component compositions of an epoxy material provided in multiple separate cartridge sections, for example, the component compositions are simultaneously dispensed, preferably with mutual proportioning controlled by suitable measures. Proportioning may be effected, for instance, by appropriately dimensioning the cartridge sections and/or dispensing openings. The dispensed compositional components thus combine upon their dispensing and application, and together cure into the desired epoxy composition to be applied.

In other examples, the system 10 may be configured to accommodate a cartridge unit having but a single cartridge section to dispense a singular component, or a pre-mixed composition. In certain other examples, the system 10 may be configured to accommodate a cartridge unit 5 having more than two cartridge sections. The actual configuration employed will depend on the particular requirements of the intended application(s).

While the illustrated example provides for application of an epoxy material, one skilled in the art will recognize that this serves illustrative purposes only, and that the disclosed system 10 may be utilized to apply any suitable material required by the intended application. The present invention is therefore not limited to the dispensing/application of any particular material or material type, nor to any particular number of components making up the material dispensed and applied.

The system 10 permits comfortable use for both above-waist-level work and below-waist-level work. It is equipped with simple and convenient measures for suitable adjustment between at least the overhand, or pistol-grip, configurational setting shown in FIGS. 1A-1B and the underhand, or suitcase-grip, configurational setting shown in FIG. 1C. If the intended application so requires, the system 10 may also be configured with other grip settings between or beyond these two main settings, so that the trigger handle portion 300 is optimally positioned in angular position with respect to the frame portion 200 to carry out different application tasks.

The adjustment/reconfiguration may be effected without disassembling, removing, or replacing any part of the system. Preferably, the user need only loosen, rotate, then re-tighten a trigger handle portion 300 about the cylinder 110 of the body portion 100 to convert the system between its configurational settings. This is illustratively described in greater detail in connection with FIGS. 7A-7C. Pneumatic communication between trigger handle portion 300 and the cylinder 110 is preferably preserved at each of these settings.

In the overhand, or above the waist configuration, the pneumatic cylinder 110, actuator 150, and frame portion 200 are held over the trigger handle portion 300, and the cartridge unit 5 is securely cradled within the frame portion's upright support structure 210. Disposed as it is below these upper parts, trigger handle portion 300 is configured much like the handle/trigger assembly of a bazooka or other such device, with the first grip member 315*a* and trigger 310*a* providing a convenient pistol grip structure for a user to firmly grip and operate the system.

In the underhand, or below the waist configuration, the system 10 is held seemingly upside down, with the pneumatic cylinder 110, actuator 150, and frame portion 200 suspended below the trigger handle portion 300. The second grip member 315*b* and trigger 310*b* then define a suitcase style grip structure by which a user may conveniently and firmly hold the system for operation. That is, the dispensing portions of the system are held under the user's grip, suspended thereby to easily reach lower-lying work areas. Although the system 10 is thus inverted for use, at least the support structure 210 (preferably, the overall frame portion 200) is re-oriented such that it remains upright, and the cartridge unit 5 stays securely cradled within the support structure 210. This enables prolonged use of the system 10 with the dispensing portions held lower without sacrificing cartridge cradling security, and without requiring uncomfortable bodily contortion or undue strain by the user.

Preserving Stable Adaptive Support of Cartridge Unit

While prolonged operation of system 10 primarily in either the overhand or underhand configurations impels adjustment of the trigger handle portion 300 to its corresponding pistol grip or suitcase grip position, the system need not be reconfigured each time it is subjected to short, temporary periods of inverted operation. Suitable measures are provided such that system 10, even when set to one configuration, may be temporarily inverted and operated as if it were in the other configuration without fear of the cartridge unit 5 dislodging from the frame portion 200. The stabilization and stopping members 220, 230 formed in the illustrated embodiment, for instance, cooperatively serve to provide adequate retention of the cartridge unit 5 even when the frame portion's support structure is temporarily flipped over, and its open end faces downward. Although not ideally cradled within the support structure 210 at that point, the stabilization and stopping members 220, 230 provide sufficient proximate and distal end support to keep the cartridge unit 5 safely retained until the system 10 is turned back over to hold the support structure 215 upright again.

As shown, the actuator 150 includes in the disclosed embodiment a pair of press plates 152*a*, 152*b* secured to the ends of pistons 154*a*, 154*b* which are driven to extend out of or retract into the cylinder 110. For proper operation of system 10, the cartridge sections must remain sufficiently supported to avoid misalignment with the cylinder 110 and pistons 154*a*, 154*b*. Only then will the disc portions of the cartridge unit 5 be pushed straight in for proper extrusion of the work material from each cartridge section. Otherwise, the operational seal between the disc and surrounding portions at the rear end of a cartridge section could be disrupted, and a messy leak of the work material could occur. Consistent alignment is maintained in system 10 by the combined effect of its stabilization and support members 220, 230 even during the short temporary uses, as mentioned, where the system 10 may be momentarily oriented upside down for the operational configuration it is set to (overhand or underhand configuration).

The stabilization member 220 is preferably formed to include a stabilization plate 222 that is coupled to extend in resiliently biased manner to a proximal (or rear) end 212 of the support structure 215. In the disclosed embodiment, the stabilization plate 222 is slidably disposed on a pair of slide rods 224*a*, 224*b* to capture a pair of spring elements 226*a*, 226*b* (shown coaxially fitted about the slide rods 224*a*, 224*b*) against the proximal end plate 212. The stabilization plate 222 is formed on its front surface with a first set of grooves 223*a* which are dimensioned and contoured to receive the back edge of a given cartridge section. The stabilization plate 222 is also formed on its front surface with a second set of grooves 223*b* which are dimensioned and contoured to receive the back edge of a another cartridge section where, as in the illustrated embodiment, the cartridge unit 5 includes multiple cartridge sections for multiple material components.

Thus, when a cartridge unit 5 is loaded in the cartridge bay defined by the support structure 210, the terminal back ends of its cartridge sections engage the grooves 223*a*, 223*b* of the stabilization plate 222 and press the plate back towards the proximate end plate 212. The cartridge sections are secured against lateral release of their ends by their engagement with the grooves, while the spring loading action of the support plate 222 thereon causes the cartridge unit 5 to be biased forward against the distal (or front) end plate 214. The leading end of the cartridge unit 5 from which a dispensing tip (or application tube) projects then bears against the distal end plate 214, leaving the dispensing tip to emerge through the notched opening 219 formed in that end plate.

Figure 2B:
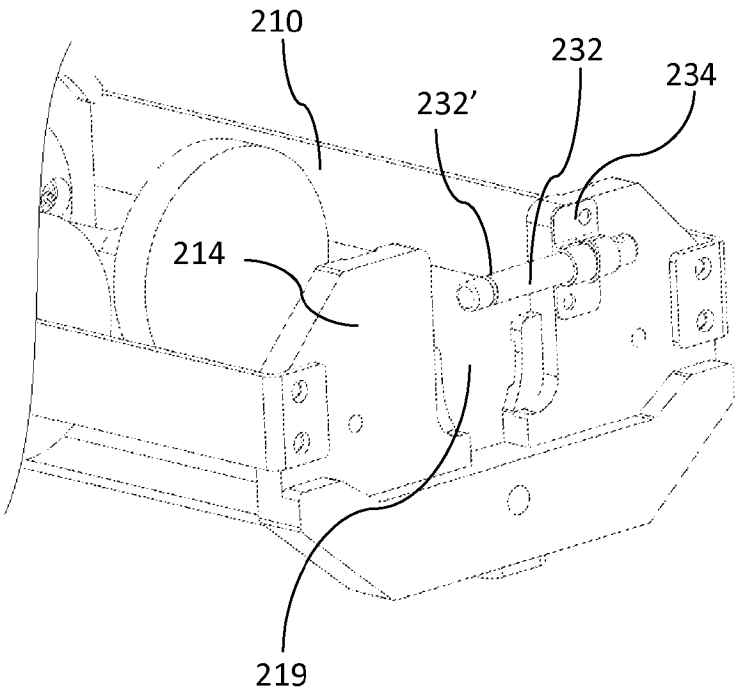
FIG. 2B is a front perspective view, partially cut away, showing a portion of the system embodiment of FIG. 1A, with a support member shown in a closed position.
Figure 2A:
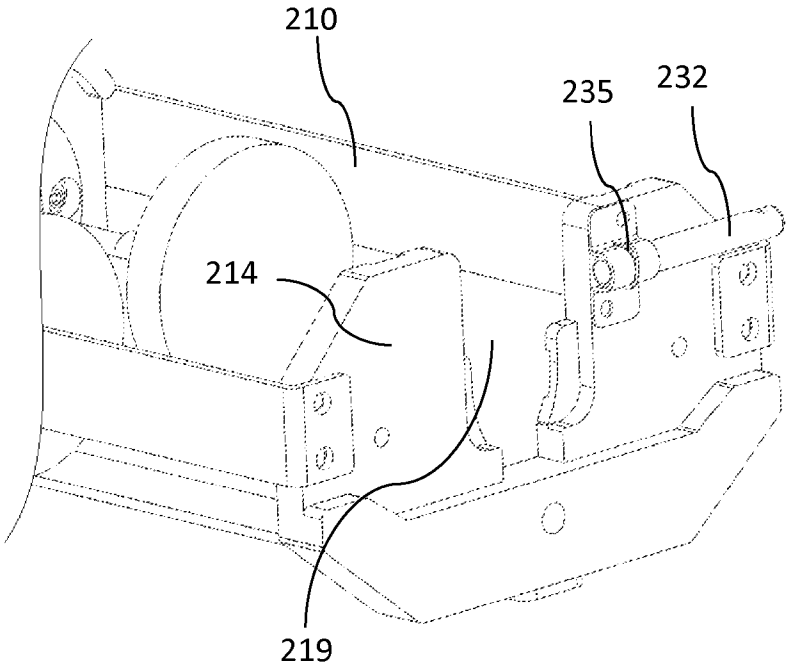
FIG. 2A is a front perspective view, partially cut away, showing a portion of the system embodiment of FIG. 1A, with a support member disposed in an open position.

Given the relatively large size and cumbersome bulk of a typical cartridge unit 5—particularly when compounded by the irregular shape typical of multiple component units—the support structure 210 is preferably formed with ready, open access to the cradling bay that it defines. In the exemplary embodiment shown, the support structure 210 is formed much as an open framed basket that is fully open at the top so that the cartridge unit 5 may be quickly and easily loaded and unloaded through the top. A displaceable stopping member 230 provided at the front end plate 214 serves to retractably close the notched opening 219, over the cartridge unit's dispensing tube passing therethrough. As shown in FIGS. 2A-2B, the stopping member 230 is illustratively implemented as a stopping pin 232 formed of a metal or other material of suitable strength and rigidity, which is slidably mated to a collar bracket 234. A spring clip 235 disposed in the collar bracket 234 engages one or more annular notches 232' (or other suitable formation) at different points along the length of the pin 232 to releasably lock the same alternatively in the retracted or stopping positions shown in FIGS. 1A and 2B.

In its stopping position, the stopping pin 232 extends obstructively across much of the notched opening 219 of the end plate 214. There, the stopping pin 232 extends over and blocks the cartridge unit's dispensing tip from slipping out of the notched opening 219, or dipping too much, should the support structure 210 for instance be flipped over temporarily for inverted operation of the system 10. When retracted, the stopping pin remains substantially clear of the notched opening 219, making way for the dispensing tip to be freely dropped in or pulled out therethrough.

Figure 3:
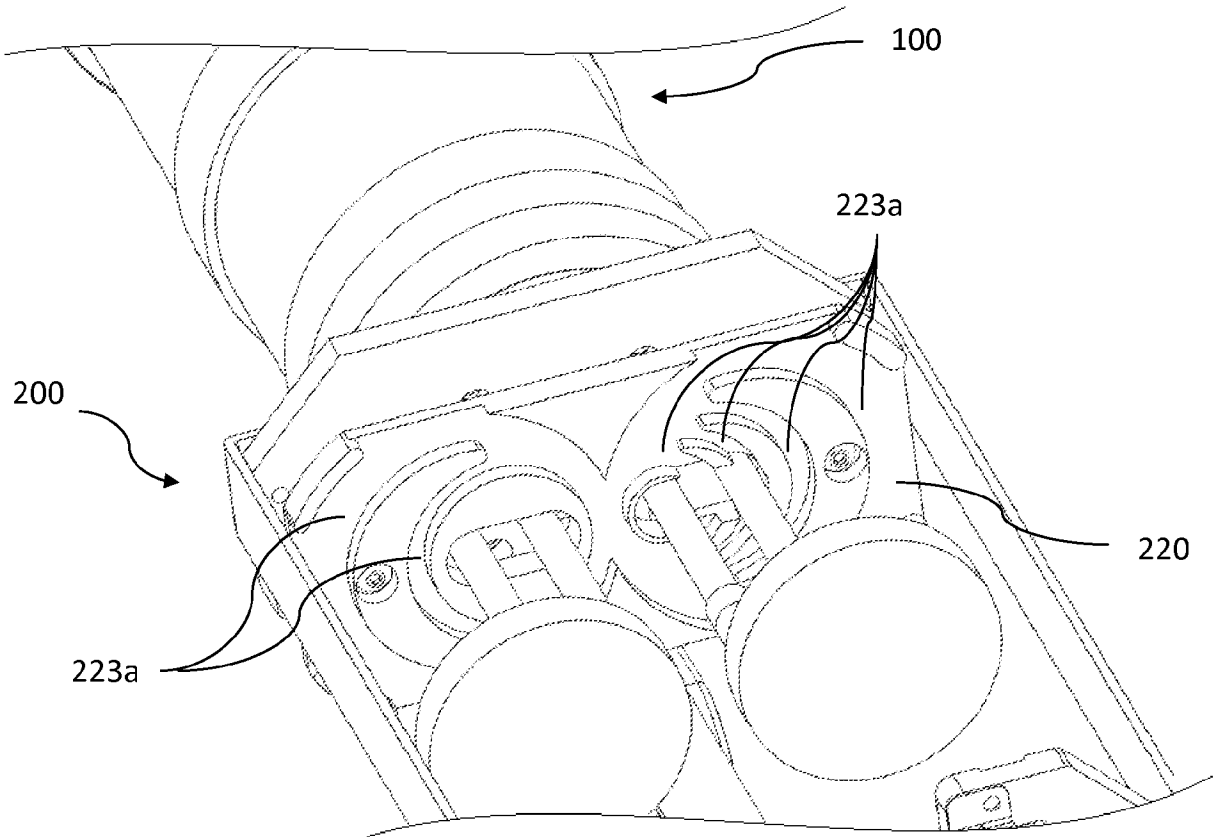
FIG. 3 is an enlarged front perspective view, partially cut away, showing another portion of the system embodiment of FIG. 1A.

Referring to FIG. 3, the first and second sets of grooves 223*a*, 223*b* of the stabilization plate 222 are shown more closely. These first and second sets of grooves 223*a*, 223*b* in the illustrated embodiment are each contoured to define annular profiles sufficient for intimate engagement with the ends of tubular cartridge sections (having substantially circular sectional contour). Multiple eccentrically disposed annular grooves are defined in each set 223*a*, 223*b* to adaptively accommodate various cartridge sections having different diametric dimensions.

Among other things, this enables convenient control over proportioning of multiple material components—by suitably sizing the cartridge sections with different tubular diameters. For example, different cartridge section sizes may be paired in one cartridge unit 5, depending on the particular types of epoxy material used and component mixture ratios required. By way of illustration, the system 10 may be configured for a cartridge unit 5 having two cartridge sections of equal diameter (or, 'disc size'), such as to establish a 750 mm×750 mm disc size pairing ratio. Depending on the particular material composition to be dispensed and applied, various other mixture ratios may be suitably realized. Certain epoxies are known, for instance, which require mixture ratios on the order of 10 to 1. The dimensional ratio for disc pairing may be selected accordingly for each different application.

The different groove profiles of the stabilization plate 222 accommodate the differently sized cartridge sections. The groove sets 223*a*, 223*b* provide a plurality of size options for the cartridge sections such that the circumferential back edge of each will make at least partial annular engagement therewith. The engagement provides sufficiently conformed fit for each cartridge section to sustain stable support, even where cartridge sections of different diameters are paired together in the given cartridge unit 5.

As illustrated in the closer view of FIG. 3, a smaller disc cartridge section may be inserted on one set of grooves 223*a* than on the other set of grooves 223*b* to yield a cartridge unit 5 of uneven mixture ratio. The grooves 223*a*, 223*b* fix the seated cartridge section ends so that they cannot move around. This is aided by the spring bias of the stabilization plate 222 against the cartridge section ends. The cartridge unit 5 is thereby resiliently locked at its back end so that it will not shift laterally and cause misalignment with the driving piston 150 during use.

With the proportioning enabled by system 10, a user may with one dispenser/applicator device do the work of many differently sized and configured devices. It would not be uncommon heretofore in the art to have as many as five or six separate applicators at the ready to accommodate the different cartridges/cartridge section sizes that the given material(s) typically come in. Where required, the stabilizing plate 222 having a certain groove set configuration may be replaced with another such plate having a different groove set configuration. For example, the stabilizing plate 222 may simply be snapped on and off, in order to replace one stabilizing plate 222 for another as needed.

Trigger Handle Example for Pneumatically Powered Applications

Figure 4A:
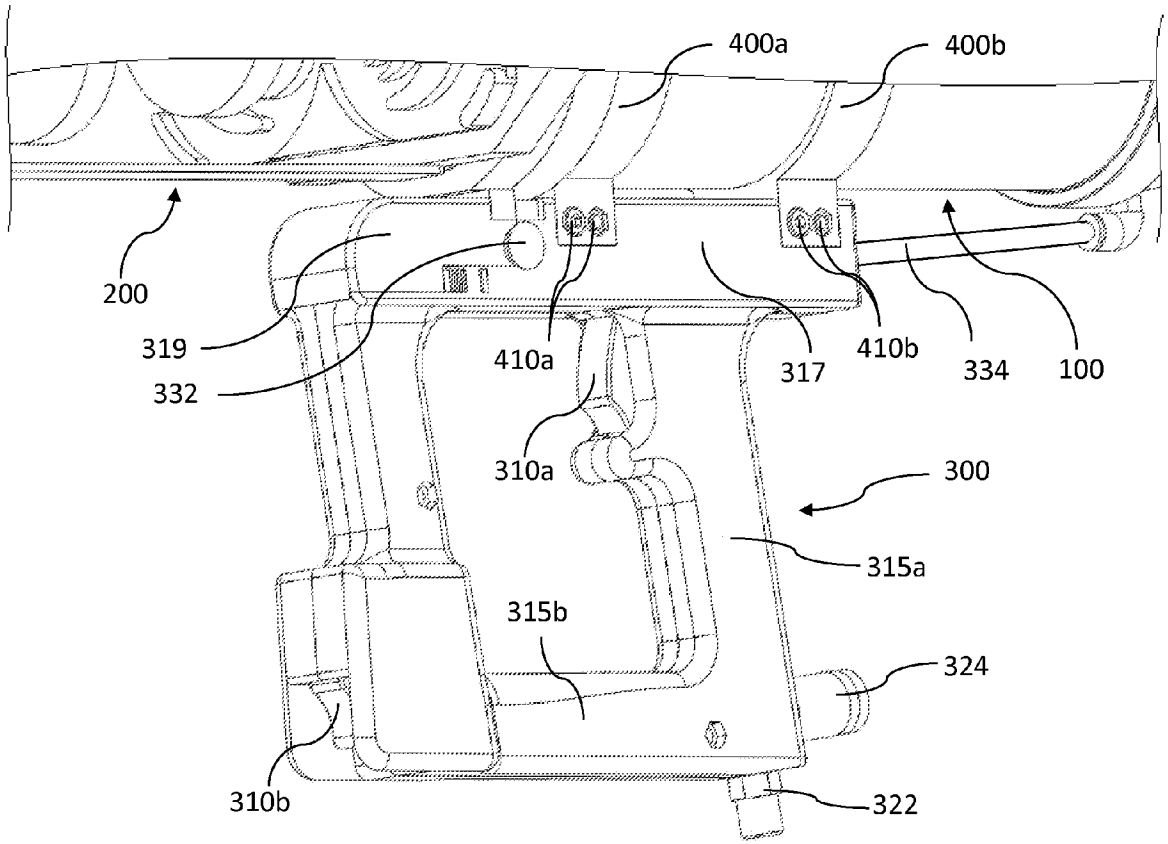
FIG. 4A is an enlarged side perspective view, partially cut away, showing a trigger handle portion of the system embodiment of FIG. 1A, oriented for pistol-grip type operation.
Figure 4B:
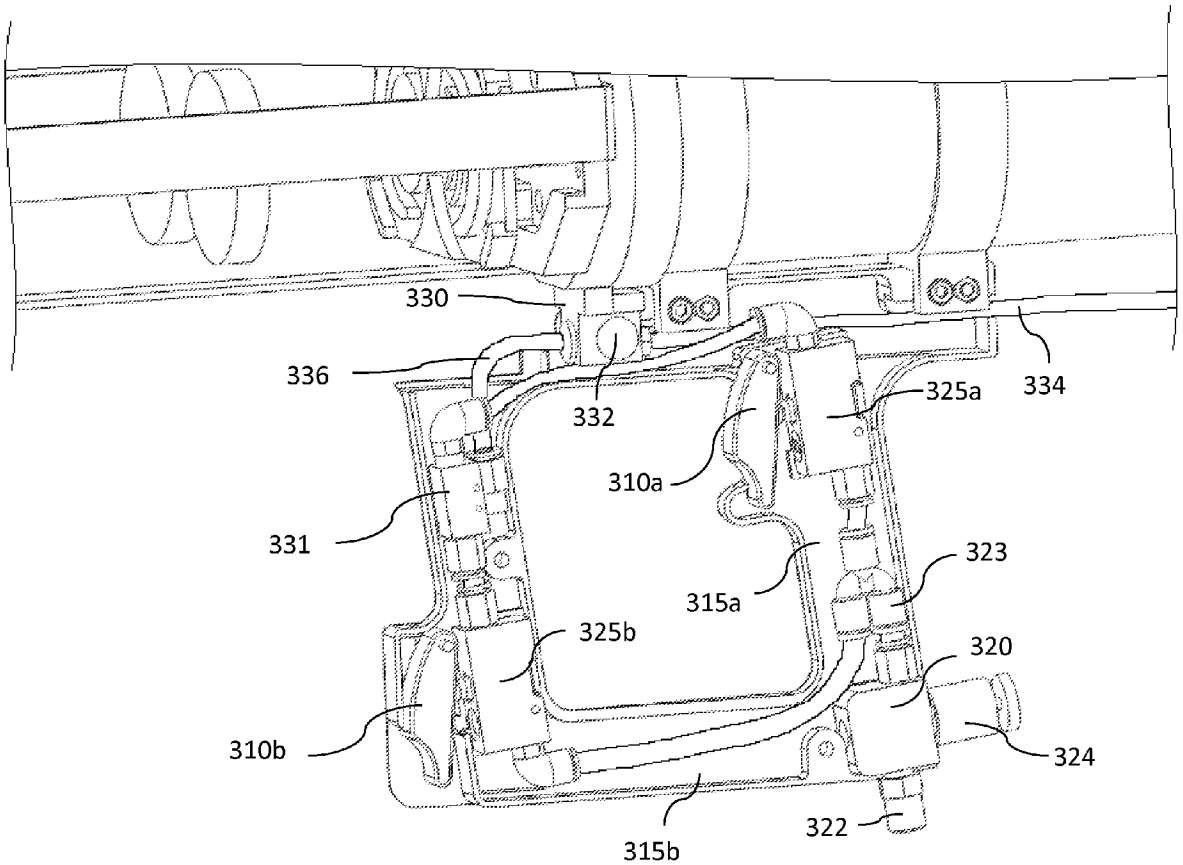
FIG. 4B is an enlarged side perspective view, partially cut away, showing an intercoupling of components within a trigger handle portion of the system embodiment of FIG. 1A, oriented for pistol-grip type operation.

Turning next to FIGS. 4A-4B, an exemplary embodiment of the combination trigger handle portion 300 is shown in greater detail. Preferably, the trigger handle portion 300 is attached to the cylinder 100 of the pneumatic applicator by one or more adjustable cylinder straps, 400*a*, 400*b* which loop intermediately about the cylinder 110. In the illustrated embodiment, the combination trigger handle portion 300 is releasably attached this way by two of these ring-like cylinder straps 400*a*, 400*b* which couple to an upper extension 317 of the portion 300 by releasable fasteners 410*a*, 410*b*. As described in following paragraphs, to re-configure system 10 the fasteners 410*a*, 410*b* may be loosened so that the cylinder straps 400*a*, 400*b* may be adjusted in angular or linear position on the cylinder 110 (to re-position the trigger handle portion 300 accordingly), then re-tightened to secure at the new position.

In the pneumatically-powered embodiment disclosed, the trigger handle portion 300 incorporates a flow regulator 320 to receive the incoming pneumatic flow from a source (such as pressurized air or other suitable gas). The flow regulator 320 preferably includes a flow inlet 322 and an air pressure adjusting button 324 which may be operated to adjustably limit the air pressure permitted to flow into the system. A certain air pressure limit is typically set for a given cylinder 110 for safety reasons. If too high of an air pressure were received at the inlet 322, the adjusting button 324 may be accordingly set to preserve safe operating conditions, so that when the user actuates the trigger, the system 10 performs as expected. The excess air is thereby prevented from going into the cylinder 100, and sudden, aberrant operation avoided. Hence, the excess air not required for proper system operation is kept from even entering the cylinder 100. Such provides an added safety feature not seen in comparable dispensing/applicator devices heretofore known in the art.

The trigger handle portion 300 further includes a first triggering mechanism 325*a* disposed within/near the first, pistol grip, member 315*a*, and a second triggering mechanism 325*b* disposed within/near the second, pistol grip, member 315*b*. These first and second triggering mechanisms 325*a*, 325*b* are both pneumatically coupled to the flow regulator 320, such as by a Y-coupler or other type of union joint 323, to receive the incoming pressurized air flow therefrom. Each triggering mechanism 325*a*, 325*b* is independently actuated by user activation of its corresponding first or second trigger 310*a*, 310*b* to pass the received air flow on to the cylinder 110.

Preferably, this passage of air flow occurs through a directional valve 330 disposed in the trigger handle portion 300, which is selectable in configuration to convey the air flow received from one or both of the triggering mechanisms 325*a*, 325*b* to the cylinder 110 in such manner as to either advance or retract the actuator 150. In the embodiment shown, the air flow is actually passed through an intermediate joint 331 which receives the air flow from each of the triggering mechanisms 325*a*, 325*b* at different input ports and conveys the same to the valve 330 through a combined output port. The directional valve 330 is formed with a selector switch 332 which is user activated to alternatively set the valve 330 to at least forward and reverse settings (may also include a neutral/disabled safety setting in certain alternate embodiments). When in the forward setting, the directional valve 330 in this embodiment directs the received air flow to the rear of the cylinder 110 (such as via a conduit 334) where it pneumatically forces one or more of the pistons 154*a*, 154*b* forward (to advance further into the frame portion 200). When in the reverse setting, the directional valve 330 in this embodiment directs the received air flow to the front of the cylinder 100 where it pneumatically forces one or more of the pistons 154*a*, 154*b* rearward (to retract back into the cylinder 110).

In actual practice, this is very handy because when a user has fully exhausted a cartridge unit of material, the reverse operation provides a convenient way to retract the piston rods 154*a*, 154*b* which are going to be at the very front ends of their cartridge sections. So the user may conveniently set the selector switch 332 to reverse, and then activate either trigger 310*a*, 310*b* to cause the pneumatic flow to withdraw the piston rods 154*a*, 154*b*. The user may then remove the empty cartridge unit 5 with very little effort.

Proper reconfiguration of system 10 between its various operational configurations (pistol grip, suitcase grip, or other intermediate configurations) requires simple yet reliable measures for preserving the pneumatic seal at each of the system's configurational settings. Preferably, system 10 may be freely reconfigured by angularly displacing the trigger handle portion 300 about the cylinder 110 without compromising this pneumatic seal.

Pneumatic Coupling Preserved Reconfiguration

Figure 5:
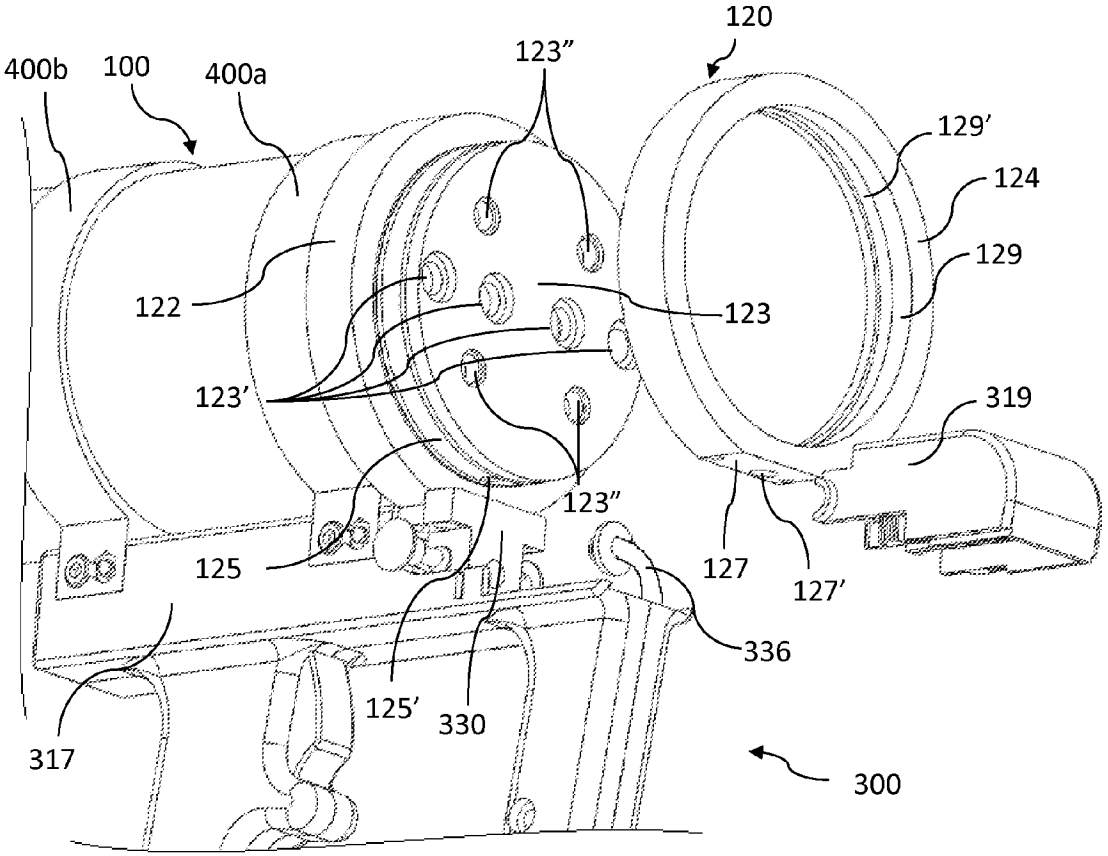
FIG. 5 is an isolated front perspective view, partially cut away, of an intercoupled trigger handle and body portions of the system embodiment of FIG. 1A oriented for pistol-grip type operation, with a certain part of the trigger handle portion shown removed.

FIG. 5 illustrates in detail one example of a rotatable front coupling assembly 120 which may be employed for the cylinder 110 in the disclosed embodiment of system 10. FIGS. 6A-6B similarly illustrate in detail one example of a rotatable rear coupling assembly 130 which may be employed for the cylinder 110 in the disclosed embodiment of system 10. These front and rear coupling assemblies 120, 130 are each pneumatically coupled to the directional valve 330. In the case of the front coupling assembly 120, it is preferably connected directly to the body of directional valve 330 aligned with one of its outlets for open communication therewith. In the case of the rear coupling assembly 130, it is preferably coupled as shown via the tubular conduit 334 to another outlet of the directional valve 330.

In FIG. 5, the system 10 is shown with the frame portion 200 removed from the body portion 100 for illustrative purposes. A protective cover 319 is further shown removed to expose the area of connection between the front coupling assembly 120 and directional valve 300. Additionally, the front coupling assembly 120 is shown in exploded view to more clearly show certain interconnected component details in the exemplary embodiment disclosed. The front coupling assembly 120 includes a front distribution member 122 which caps the front end of the cylinder 110 and a collar member 124 coaxially coupled thereto in rotatable manner.

The front distribution member 122 may be formed with any suitable air distribution structure therein (not shown) to direct the pneumatic flow received through the collar member 124 appropriately into the cylinder 110 for driving the rearward motion of one or more actuating pistons 154*a*, 154*b*. The front distribution member 122 is preferably formed with a protrusive face 123 encircled by an annular shoulder 125. The protrusive face 123 is formed with a plurality of access openings 123' through which the actuator's pistons 154*a*, 154*b* pass into the cylinder 110. The protrusive face 123 is additionally formed with fastening holes 123" for suitable fastener securement to the frame portion 200. The annular shoulder 125 is formed with an inlet opening 125' which provides pneumatic access to the internal air distribution network within the front distribution network communicating with the cylinder 110. A pair of o-ring seals 126*a*, 126*b* are disposed on the annular shoulder 125 (preferably received in a corresponding pair of endless grooves formed into the annular shoulder 125), spaced one from the other with the inlet opening 125' situated between them.

The collar member 124 coaxially receives the protrusive part of the front distribution member 122, and defines an annular inner surface 129 which then surrounds the annular shoulder 125. Formed in the inner surface 129 is an annular recess 129' which forms a ring-shaped flow space about the annular shoulder 125 between the seals 126*a*, 126*b* captured between the surrounding (un-recessed) inner surface 29 and the annular shoulder 125. The ring-shaped flow space remains in continuous open communication with the inlet opening 125' as the collar member 124 is rotated about the annular shoulder 125 of the front coupling assembly 120.

The collar member 124 is formed on its outer periphery with a mounting face 127 which accommodates the directional valve 330. Along with fastening holes, an inlet opening 127' is formed at this mounting face 127. The inlet opening 127' passes through to the annular recess 129' and communicates with the ring-shaped flow space defined thereby. Thus, when the directional valve 330 is mounted to the collar member 124 (with its outlet sufficiently aligned to communicate with the inlet opening 127'), a pneumatic communication path between the trigger handle portion 300 and the cylinder 110 is preserved through the front coupling assembly 120 regardless of what angular position trigger handle portion 300 may be rotated to about the cylinder 110.

Upon full assembly of the system 10, the collar member 124 is captured in place by the frame portion 200. Suitable fastening members are passed through the frame portion's proximate end plate 212 to engage the fastening holes 123" of the protrusive face 123. The proximate end pate 212 then stops the collar member 124 against axial release, keeping it retained in suitably rotatable manner about the annular shoulder 125.

Figure 6:
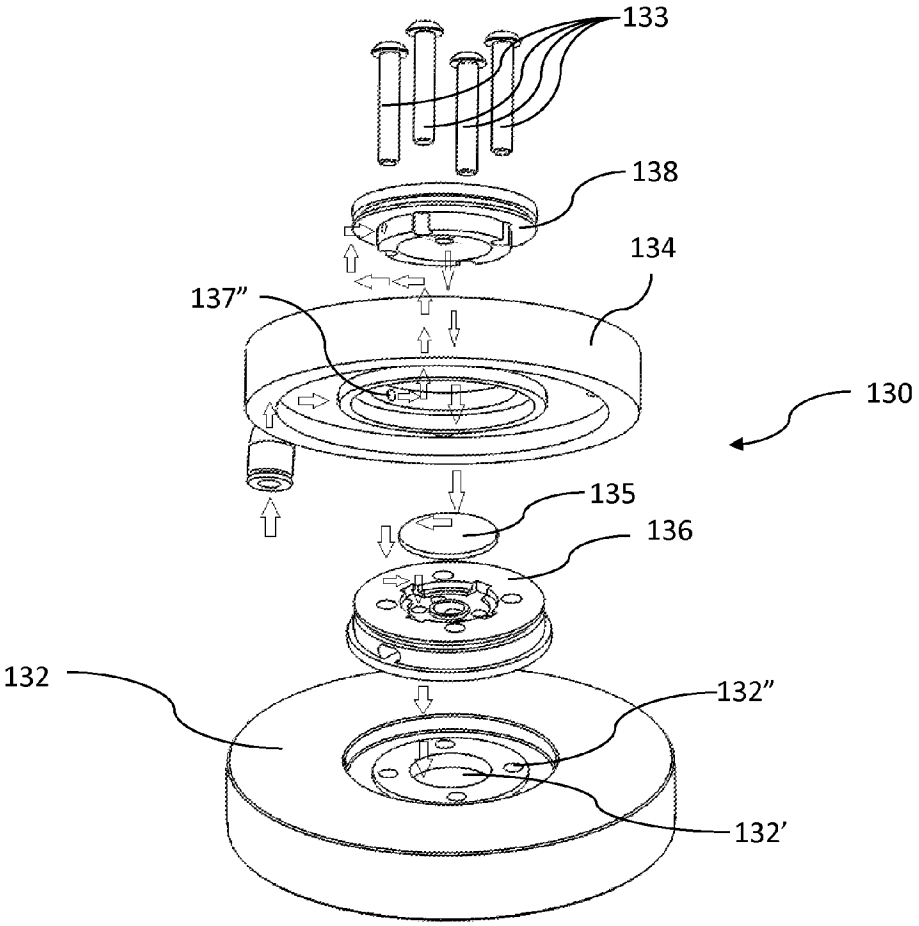
FIG. 6 is an exploded side perspective view of a rear coupling assembly employed in the system embodiment of FIG. 1A.
Figure 6A:
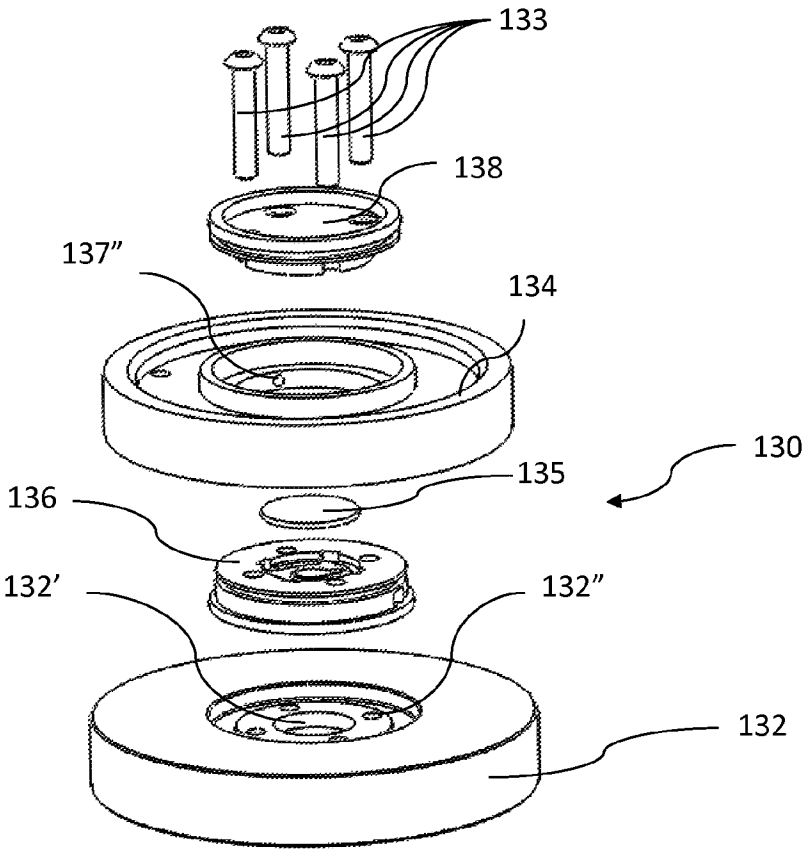
FIG. 6A is an exploded upper perspective view of a rear coupling assembly shown in FIG. 6.
Figure 6B:
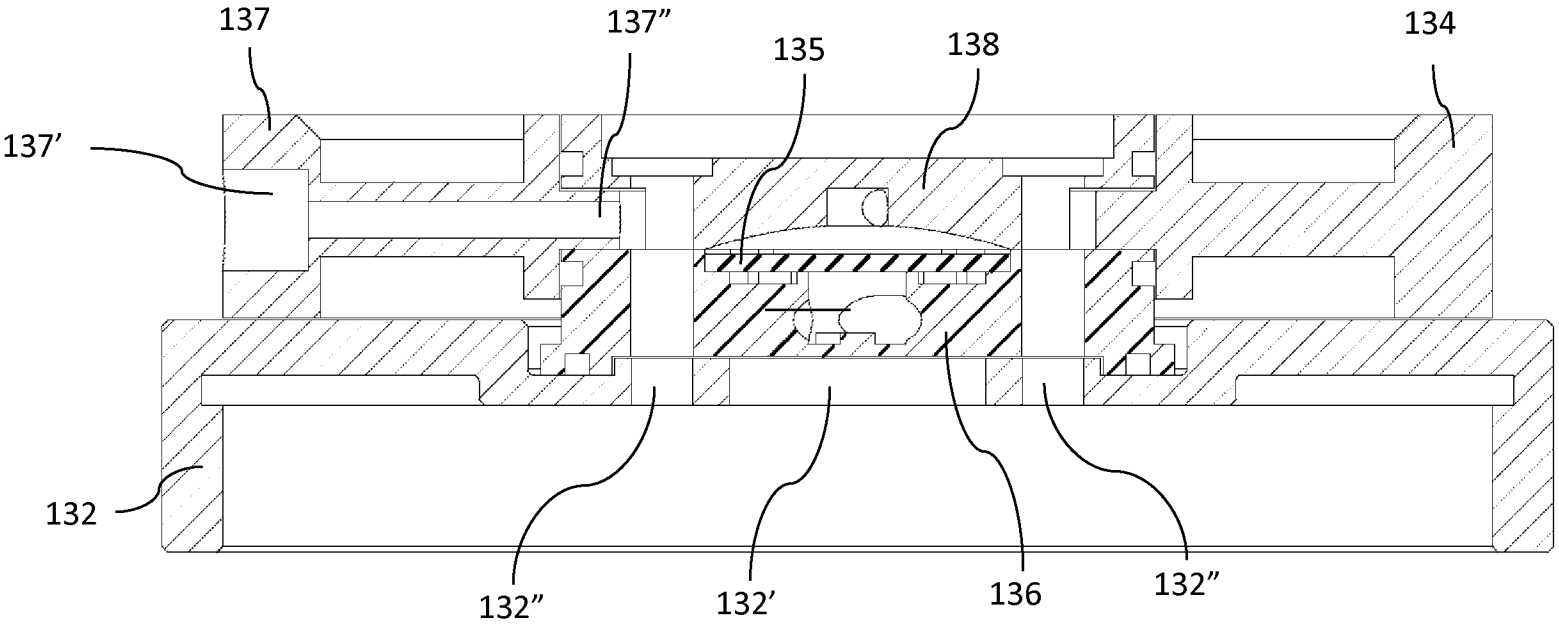
FIG. 6B is a sectional view of the rear coupling assembly shown exploded in FIG. 6.

FIGS. 6 and 6A-6B illustrate in detail one example of a rotatable rear coupling assembly 130 which may be employed for the cylinder 110 in the disclosed embodiment of system 10. As shown in the exploded views of FIGS. 6 and 6A, the rear coupling assembly 130 includes a rear cap member 132 which caps the rear end of the cylinder 110. The rear cap member 132 is formed with a central rim defining a central inlet opening 132'. A plurality of fastening holes 132" are formed in the central rim.

The rear coupling assembly 130 includes as well a collar member 134 rotatably disposed coaxially about an axle structure formed by an inner axle member 136 and an outer axle member 138 (and a diaphragm 135 disposed between them). The inner and outer axle members 136, 138 are fastened to the rear cap member 132 by a plurality of fasteners 133 which pass through intermediate holes in each of the axle members to engage the rear cap member's fastening holes 132". Peripheral portions of the two axle members 136, 138 axially sandwich the collar member 134, so that it remains captured in coaxially rotatable manner between them. Any suitable o-ring type sealing measures and air flow distribution structure may be formed in the axle members 136, 138 to preserve pneumatic communication from an inlet opening 137' (formed through a periphery 137 of the collar member 134) on to the central inlet opening 132' therethrough. As with the front coupling assembly 120, a pneumatic communication path between the trigger handle portion 300 and the cylinder 110 is preserved through the rear coupling assembly 130 regardless of what angular position trigger handle portion 300 may be rotated to about the cylinder 110.

FIG. 6 illustrates via a sequence of directional arrows the typical paths of air flow as guided and communicated by/through various parts of the rear coupling assembly 130. With the tubular conduit 334 coupled to the periphery 137 of the collar member 134, air flow passed from an outlet of the directional valve 330 is passed in through the inlet opening 137' to emerge from an inner opening 137" into a flow space defined between the axle members 136, 138. The air flow then passes through the distribution network formed by these axle members 136, 138 to eventually pass through the central inlet opening 132' of the rear cap member 132 and into the rear end of the cylinder 110, to urge the actuating pistons 154*a*, 154*b* forward.

As mentioned, the trigger handle portion 300 is coupled to the body portion 100 so that it may be adjusted without disassembly and reassembly for safe and effective use in a pistol grip configuration above the waist or a suitcase configuration below the waist. Even without major disassembly and reassembly, required adjustment may be fully made in a matter of a couple minutes, as opposed to maybe 15 to 20 minutes or more that might otherwise be needed to effect a similar changeover in comparable dispensing/applicator devices known in the art.

Reconfiguration

Figure 7A:
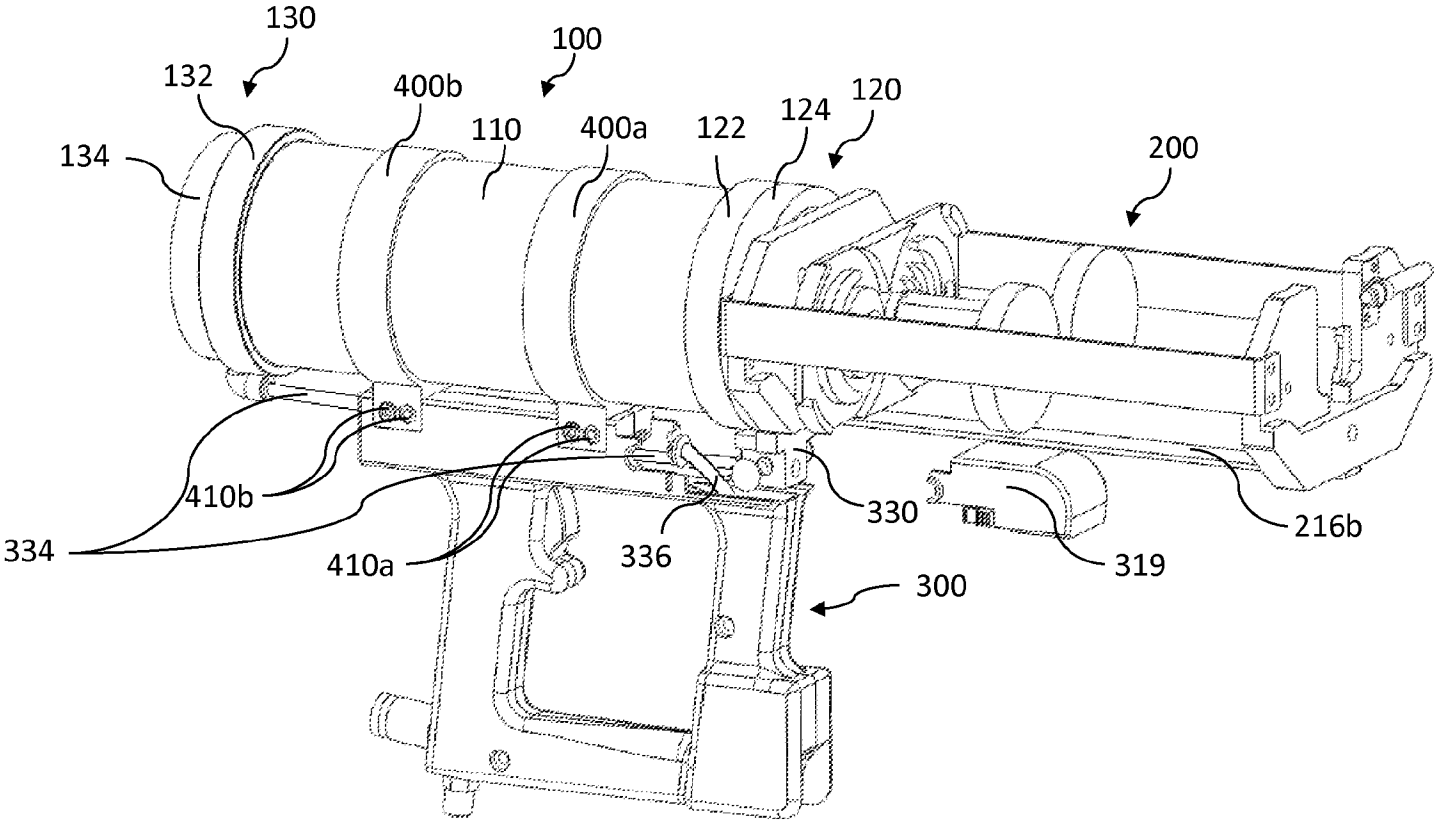
FIG. 7A is a side perspective view of the system embodiment of FIG. 1A, set to the first operational configuration and shown in an upright orientation for that operational configuration, with a certain part of the trigger handle portion shown removed in preparation for system reconfiguration.
Figure 7B:
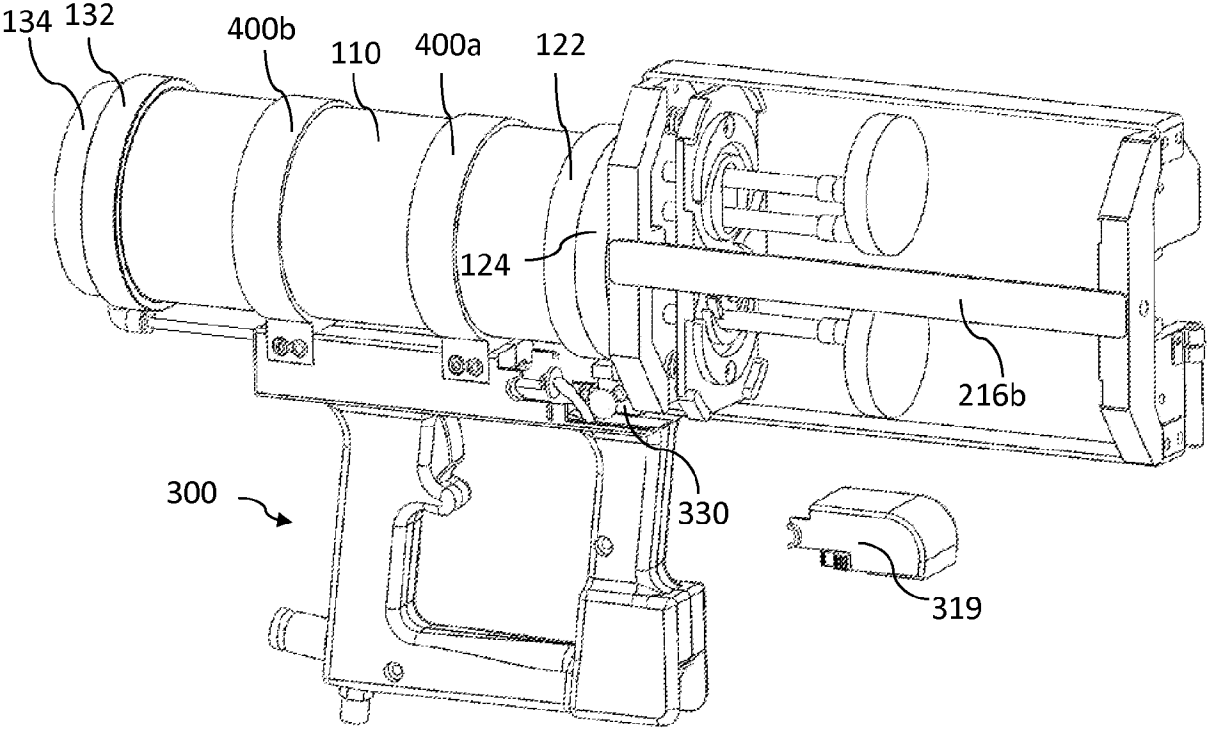
FIG. 7B is a side perspective view of the system embodiment of FIG. 1A, at an intermediate setting during reconfiguration between the first and second operational configurations, with a certain part of the trigger handle portion shown removed in preparation for system reconfiguration; and, FIG. 7C is a flipped side perspective view of the system embodiment of FIG. 1A, after full reconfiguration to the second operational configuration shown in FIG. 1C.
Figure 7C:
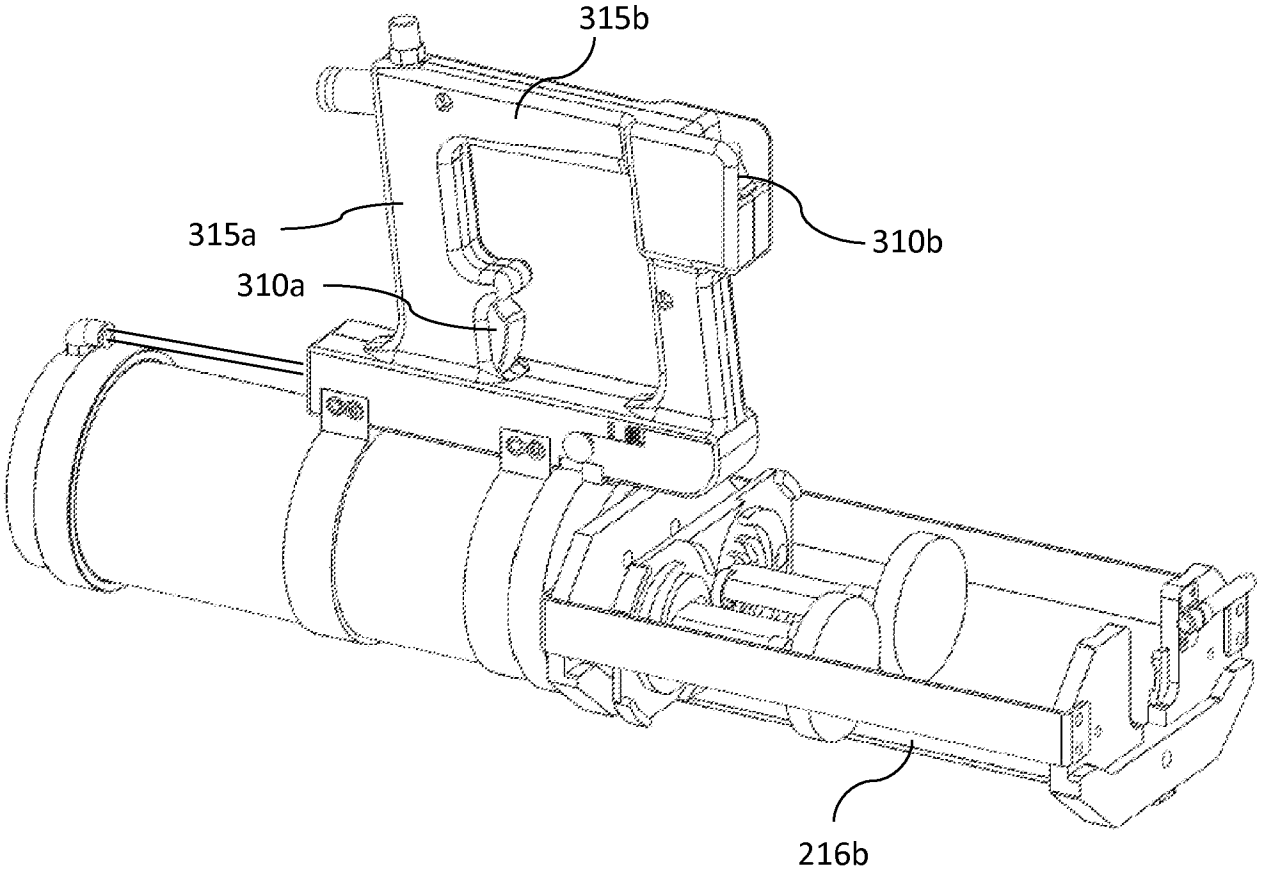

Turning to FIGS. 7A-7C, the trigger handle portion 300 may be adjusted between the overhand, pistol-grip, configuration shown in FIG. 7A to the underhand, suitcase-grip, configuration shown in FIG. 7C. With the system set in the pistol-grip configuration, a user wish to use the system 10 for extended periods in the suitcase-grip configuration. Instead of simply holding the cage/frame upside down by the suitcase grip member 315*b*, the user would adjust the trigger handle portion 300 to reorient it with respect to the frame portion 200, such that the frame portion 200 remains right side up when the system 10 is used for below-the-waist application. The user may so reconfigure the system 10 as follows.

The protective cover 319 is first removed from the trigger handle portion 300 to avoid obstruction by other portions of the system when the portion 300 is rotated about them. Removing the protective cover 319 also reveals the connection point of the tubular conduit 336 from the intermediate joint 331 (serving the triggering mechanisms 325*a*, 325*b*) to rotate the portion 300 with minimal restriction. Next, the fasteners 410*a*, 410*b* are loosened to loosen and release the cylinder strips 410*a*, 410*b* from their constrictive grip of the cylinder 110. The entire trigger handle portion 300 (with the cylinder strips 410*a*, 410*b*), as well as the front and rear collar members 124, 134, may then be slidably rotated to the desired angular position relative to the cylinder 110 (and its front and rear capping assemblies 122, 132). In the intermediate angular position shown in FIG. 7B, the trigger handle portion 300, cylinder strips 410*a*, 410*b*, and front/rear collar members 124, 134 are all mid-way displaced to the extent that the portion 300 is roughly a quarter turn out of alignment with the bottom frame member 216*b* of the frame portion's support structure 210. If the displacement is continued, another quarter turn, the trigger handle portion 300, cylinder strips 410*a*, 410*b*, and front/rear collar members 124, 134 are all positioned such that the support structure 210 is now inverted in relation to the trigger handle portion 300. Thus, when the user were to now hold the system 10 underhand by the suitcase grip member 315*b*, the cartridge bay formed by the support structure 210 would be oriented upright (with its full access opening at the top). Such use may be made once the fasteners 410*a*, 410*b* are re-tightened to re-fasten the cylinder strips 400*a*, 400*b* firmly about the cylinder 110, any tubular conduit disconnected for this process is re-connected, and the protective cover 319 is replaced.

To facilitate this reconfiguration process, each of the tubular conduits 334, 336 may be first disconnected from the rear collar member 134 and directional valve 330. This would allow independent slidable rotation of each collar members 124, 134 unrestricted by the trigger handle portion, which may be rotated separately with the cylinder strips 400*a*, 400*b*. Once the all the parts are re-positioned, the tubular conduits 334, 336 may be reattached for subsequent operation.

The disclosed collar coupling of the trigger handle portion 300 provides continuous adjustability, much like an infinitely adjustable system. In certain alternate embodiments, the trigger handle portion 300 may be coupled to the cylinder 110 using other suitable means. For example, annular grooves may be formed in the body of cylinder 110, with the cylinder's walls suitably sized to support such grooves without structural compromise. Further, the cylinder 110 may be formed with other structural features as sectional contour, dimensional proportions, and the like.

Again, a user may make quick use of the system 10 in both a pistol and a suitcase configuration, even without such reorientation of the trigger handle assembly, since the stopping member 220 would provide a measure of protective support for the dispensing end of the cartridge unit 5. On the other hand, if a user is so inclined, he/she may selectively reconfigure the system 10 as described in preceding paragraphs, so that the frame portion 200 is disposed at an orientation more consistent with the trigger handle portion's angular position.

Typically, the reconfiguration/adjustment need not be effected too often. In many applications, a user will operate the system 10 in one setting, probably for the entire duration of a given project. Some users may simply feel more secure and comfortable if the frame portion 200 remains upright, or fully open only at the top, during operation. For most users, the stabilizing plate and locking bar may provide sufficient stability for the occasional use in the reverse/upside down orientation.

In alternate embodiments, the system 10 may not require rotatable collar members at the cylinder's end caps. If the ends of the cylinder were connected to the trigger handle portion 300 via long enough pneumatic tube connections, the trigger handle portion 300 may itself be re-positioned without requisite re-positioning of the connection points at the end caps. It may present other practical difficulties, but as long as a tube extends from trigger handle portion 300 to the given end of the cylinder with sufficient slack when in certain desired angular positions, it would not be necessary to rotate the end caps to preserve pneumatic communication. But the directional valve 330 would accordingly be of different structure in order to preserve connection with the front end of the cylinder 110 when the trigger handle portion 300 is rotated around the cylinder 110.

As far as the optimal position of the trigger handle portion 300, it is suitably positioned along the cylinder's length to provide optimal balance of the system 10 for use. If the trigger handle portion 300 were positioned too far back, the balance would be off and the system 10 may feel a lot heavier than it actually is. This is especially so, when a full cartridge unit 5 is loaded for use.

The various portions, parts, and components of the system disclosed herein may be formed of any suitable material known in the art for the particular requirements of the intended applications. Metallic, plastic, rubber, and other such materials are employed in view of such factors as the required combination of strength, rigidity, weight, and the like. The present invention is not limited to any particular choice of such material compositions.

Although this invention has been described in connection with specific forms and embodiments thereof, it will be appreciated that various modifications other than those discussed above may be resorted to without departing from the spirit or scope of the invention as defined in the appended claims. For example, functionally equivalent elements or processes may be substituted for those specifically shown and described, certain features may be used independently of other features, and in certain cases, particular locations of the elements or processes may be reversed or interposed, all without departing from the spirit or scope of the invention as defined in the appended claims.

What is claimed is:

1. A reconfigurable applicator system for extrusive dispensing of a work material comprising:

a body portion having an actuator coupled thereto;

a frame portion coupled to said body portion, said frame portion defining a support structure for at least one cartridge unit containing the work material; and, a combination trigger handle portion coupled to said body portion, said combination trigger handle portion being adjustable while remaining coupled to said body portion between angularly displaced first and second grip positions relative to said frame portion, said combination trigger handle portion including at least first and second selectable triggers coupled to said actuator, said actuator responding to each of said first and second triggers to actuate extrusive dispensing of the work material from the cartridge unit;

wherein said combination trigger handle portion in said first and second grip positions alternatively configures the system between overhand and underhand configurations.

2. The system as recited in claim 1, wherein said frame portion includes a displaceable stopping member for releasably capturing a distal end of the cartridge unit within said support structure to maintain uninterrupted retention of the cartridge unit therein when the system in one of said overhand and underhand configurations is alternatively operated in an inverted orientation corresponding to the other of said overhand and underhand configurations.

3. The system as recited in claim 2, wherein said stopping member includes a locking pin longitudinally displaceable to extend obstructively across a notch formed at an upper edge of said support structure for receiving the distal end of the cartridge unit.

4. The system as recited in claim 2, wherein said frame portion includes a stabilization member for releasably capturing a proximal end of the cartridge unit within said support structure to maintain uninterrupted retention of the cartridge unit therein when the system in one of said overhand and underhand configurations is alternatively operated in an inverted orientation corresponding to the other of said overhand and underhand configurations.

5. The system as recited in claim 4, wherein said stabilization member defines at least one set of retention grooves for retentively engaging the proximal end of a correspondingly configured cartridge unit.

6. The system as recited in claim 5, wherein said stabilization member defines at least first and second sets of retention grooves on a stabilization plate bearing transversely against the proximal end of the cartridge unit, said first and second sets of retention grooves respectively including arcuate segments eccentrically disposed one relative to the other for adaptive engagement of the proximal ends of differently sized cartridge units.

7. The system as recited in claim 1, wherein the system executes power-assisted extrusive dispensing of the work material, said body portion including a cylinder for driving a piston unit in power-assisted manner to extend reversibly therefrom into said frame portion, whereby the work material is forced to extrusively dispense from the cartridge unit.

8. The system as recited in claim 7, wherein the system is pneumatically powered, said cylinder delivering pneumatic pressure to said piston unit responsive to user activation of said first or second trigger.

9. The system as recited in claim 8, wherein said handle portion includes first and second grip members transversely extending one relative to the other, said first and second triggers being coupled respectively to said first and second grip members to selectively open and close corresponding first and second pneumatic paths for directing a pneumatic flow from a source to said cylinder therethrough.

10. The system as recited in claim 7, wherein said combination trigger handle portion is slidably displaceable about said cylinder between said first and second grip positions, said combination handle portion being releasably locked at each of said first and second grip positions to extend radially outward from said cylinder.

11. The system as recited in claim 10, wherein said combination trigger handle portion is coupled to said cylinder by at least one collar member concentrically disposed thereabout, said collar member being diametrically adjustable between locked and slidable configurations relative to said cylinder.

12. An ergonomically reconfigurable applicator system for extrusive dispensing of a work material comprising:

a body portion having an actuator coupled thereto;

a frame portion coupled to said body portion, said frame portion defining a support structure for at least one cartridge unit containing the work material, said frame portion including:

a stabilization member coupled to said support structure for releasably securing a proximal end of the cartridge unit therein; and, a stopping member retractably coupled to said support structure for releasably capturing a distal end of the cartridge unit therein; and, a combination trigger handle portion coupled to said body portion to be angularly displaceable while remaining coupled to said body portion between at least first and second grip positions relative to said frame portion, said combination trigger handle portion including at least first and second selectable triggers coupled to said actuator, said actuator responding to each of said first and second triggers to actuate extrusive dispensing of the work material from the cartridge unit;

wherein said combination trigger handle portion in said first and second grip positions alternatively configures the system between overhand and underhand configurations, and said frame portion maintains uninterrupted retention of the cartridge unit within said support structure when the system configured in one of said overhand and underhand configurations is alternatively operated in a complementary orientation corresponding to the other of said overhand and underhand configurations.

13. The system as recited in claim 12, wherein said frame portion is configured to retain within said support structure thereof a multi-component cartridge unit having multiple cartridge sections joined at the distal end and extending therefrom to separately terminate at the proximal end.

14. The system as recited in claim 13, wherein said stabilization member includes a stabilization plate defining for each of the cartridge sections at least first and second sets of retention grooves for transversely engaging the proximal end of the cartridge section, said first and second sets of retention grooves respectively including arcuate segments eccentrically disposed one relative to the other for adaptively engaging the proximal ends of differently sized cartridge sections.

15. The system as recited in claim 12, wherein the system executes power-assisted extrusive dispensing of the work material, said body portion including a cylinder for driving a piston unit in power-assisted manner to extend reversibly therefrom into said frame portion, whereby the work material is forced to extrusively dispense from the cartridge unit.

16. The system as recited in claim 15, wherein the system is pneumatically powered, said cylinder delivering pneumatic pressure to said piston unit responsive to user activation of said first or second trigger, said first and second triggers being disposed to selectively open and close respective first and second pneumatic paths for directing a pneumatic flow from a source to said cylinder therethrough.

17. The system as recited in claim 16, wherein said combination trigger handle portion is coupled to said cylinder by at least one collar member concentrically disposed thereabout, said collar member being diametrically adjustable between locked and slidable configurations relative to said cylinder, said combination trigger handle portion being thereby slidably displaceable between said first and second grip positions and releasably locked at each position to extend radially outward from said cylinder.

18. An ergonomically reconfigurable applicator system for pneumatically powered extrusive dispensing of a work material comprising:

a frame portion defining a cartridge bay structure for at least one cartridge unit containing the work material, said frame portion including:

a stabilization member coupled to said cartridge bay structure for releasably securing a proximal end of the cartridge unit therein; and, a stopping member retractably coupled to said cartridge bay structure for releasably capturing a distal end of the cartridge unit therein;

a body portion coupled to said frame portion, said body portion including a cylinder for driving a piston unit in pneumatically powered manner to extend reversibly therefrom into said frame portion and actuate extrusive dispensing of the work material from the cartridge unit; and, a combination trigger handle portion adjustably coupled to said body portion for slidable angular displacement while remaining coupled to said body portion between pistol grip and suitcase grip positions thereabout, said combination trigger handle portion including:

at least first and second grip members transversely oriented one relative to the other; and, at least first and second selectable triggers coupled respectively to said first and second grip members to selectively open and close respective first and second pneumatic paths for directing a pneumatic flow from a source to said cylinder therethrough;

wherein said combination trigger handle portion in said pistol and suitcase grip positions alternatively configures the system between overhand and underhand configurations with respect to said cartridge bay structure in an upright orientation, and said frame portion maintains uninterrupted retention of the cartridge unit within said cartridge bay structure when the system configured in one of said overhand and underhand configurations is alternatively operated with said cartridge bay structure in an inverted orientation consistent with the other of said overhand and underhand configurations.

19. The system as recited in claim 18, wherein said combination trigger handle portion is coupled to said cylinder by at least one collar member concentrically disposed thereabout, said collar member being diametrically adjustable between locked and slidable configurations relative to said cylinder, said combination trigger handle portion being thereby slidably displaceable between said pistol and suitcase grip positions and releasably locked at each position to extend radially outward from said cylinder.

20. The system as recited in claim 19, wherein:

said frame portion is configured to retain within said cartridge bay structure thereof a multi-component cartridge unit having multiple cartridge sections joined at the distal end and extending therefrom to separately terminate at the proximal end; and, said stabilization member includes a stabilization plate defining for each of the cartridge sections at least first and second sets of retention grooves for transversely engaging the proximal end of the cartridge section, said first and second sets of retention grooves respectively including arcuate segments eccentrically disposed one relative to the other for adaptively engaging the proximal ends of differently sized cartridge sections.

* * * * *